US005083933A

United States Patent [19]

Colleran et al.

[11] Patent Number: 5,083,933

[45] Date of Patent: Jan. 28, 1992

[54] ELECTRICAL CONNECTOR WITH FULLY SHROUDED LOCK

[75] Inventors: Stephen A. Colleran, Lisle; Fred L. Krehbiel, Chicago; Bill B. Wilson, Montgomery, all of Ill.

[73] Assignee: Molex Incorporated, Lisle, Ill.

[21] Appl. No.: 590,261

[22] Filed: Sep. 28, 1990

[51] Int. Cl.[5] ..... H01R 13/627

[52] U.S. Cl. ..... 439/357; 439/353; 439/271

[58] Field of Search ..... 439/350, 351, 353, 357, 439/358, 587, 488, 498, 271, 273

[56] References Cited

U.S. PATENT DOCUMENTS 4,324,449 4/1982 Watanabe et al. ..... 439/353
4,449,776 5/1984 Carmo et al. ..... 439/350
4,623,210 11/1986 Tsukakashi ..... 439/358
4,634,204 1/1987 Detter et al. ..... 439/488
4,772,231 9/1988 Hayes ..... 439/283
4,900,267 2/1990 Nagasaka et al. ..... 439/489

*Primary Examiner*—Larry I. Schwartz
*Assistant Examiner*—Hien D. Vu Hau
*Attorney, Agent, or Firm*—Louis A. Hecht; Stephen Z. Weiss; A. A. Tirva

[57] ABSTRACT

An electrical connector is provided with unitarily molded housing and a wire seal cover mounted to the rear end of the housing. A latch extends from a wall of the housing and includes a forwardly projecting locking beam and a rearwardly projecting actuator. The housing further includes a shroud unitarily molded therewith to cover both sides and the top of the locking beam of the latch. The wire seal cover further includes a shroud for protecting the actuator of the latch. However, at least a portion of the shroud on the wire seal cover is open to enable actuation of the latch for unmating the connector.

13 Claims, 3 Drawing Sheets

ELECTRICAL CONNECTOR WITH FULLY SHROUDED LOCK

BACKGROUND OF THE INVENTION

Electrical connectors are employed in pairs, with each connector in the pair comprising a non-conductive housing with a plurality of electrically conductive terminals securely mounted therein. The housings of a pair of electrical connectors are constructed to mate with one another such that the terminals of one connector in the pair achieve high quality electrical connection with the corresponding terminals of the other connector in the pair.

Many electrical connectors are employed in high vibration environments, such as the many electrical connectors used in automobiles. The housings of electrical connectors intended for high vibration environments must be positively locked in the mated condition to ensure that vibrations do not move the terminals out of optimum electrical contact. The typical prior art locking means for such connectors includes at least one latch molded as part of one of the housings. More particularly, the housing of a prior art connector may include a plurality of resiliently deflectable latches for engaging corresponding locking structures on the housing of a mating connector. The latch typically will be constructed to deflect automatically during mating of the electrical connectors. Upon complete mating, however, the latch will advance beyond the locking structure of the mating connector and will resiliently return toward an undeflected condition to positively engage the opposed locking structure and retain the connectors in their mated condition. The latches of these prior art connectors may further include actuator means to enable the latch to be deflected into a position that is free of the locking structure on the connector, to enable separation or unmating of the connectors.

Potential problems with the locking means on electrical connectors have been recognized in the prior art. For example, it is known that some latches on electrical connectors may be overdeflected during mating or unmating. Such overdeflection may prevent the latch from resiliently returning toward an undeflected condition, or in extreme cases may sever the latch from its housing. An inoperative latch may enable the connectors to vibrate out of the position corresponding to optimum contact force between the terminals therein.

The latches of such prior art connectors also have functioned as hooks which are susceptible of snagging nearby wires in an electrical system. More particularly, the electrical system of an automobile includes a large number of harness assemblies comprising arrays of wires extending from one connector to another. The latching mechanism on any such connector creates the potential for hooking a wire in another harness assembly during the initial assembly of the system or during subsequent maintenance. A wire could be hooked by either the locking portion of a latch or by the actuating position. The tangling of wires with latches may render the latch substantially inoperative and may prevent complete mating of a pair of electrical connectors or may complicate the unmating of such connectors. A snagged wire could also cause the above described overstress of the latch structure.

The latches of an electrical connector may also function as a trap for debris or dirt that accumulates in many areas of an automobile. For example, debris accumulated under the actuating portion of a latch may make unmating of connectors extremely difficult.

The prior art has included many electrical connectors with latches that attempt to prevent the above identified problems. An extremely desirable latch structure is shown in copending application Ser. No. 399,048 which was filed on Aug. 28, 1989 and which is assigned to the assignee of the subject invention. The latch structure shown in copending application Ser. No. 399,048 now U.S. Pat. No. 4,986,766 extends deflectably from a body portion of the connector housing. The housing further is provided with nondeflectable walls disposed to define a shroud around deflectable portions of the latch. The shroud is intended to prevent the deflectable latch from snagging wires and further is constructed to prevent overstress of the latch. In all illustrated embodiments, the latch, shroud and housing are unitarily molded. In some embodiments the latch is cantilivered and extends between a pair of generally parallel shroud walls. In these embodiments, the shroud walls extend on opposite sides of the deflectable cantilevered latch to prevent snagging and further extend at least partly over the top of the latch to prevent overdeflection. Other embodiments disclosed in copending application Ser. No. 399,048 show an elongated latch having opposed ends. One end is unitarily connected to the housing while the other end is unitarily connected to the shroud structure. In these embodiments the central portion of the latch is deflectable to lock with a mating connector. The locking structures depicted in copending application Ser. No. 399,048 have performed very well. However, these desirable prior art locking structures often required complex molding processes. Additionally, it is now considered desirable to provide even further shrouding of deflectable components and additional protection against accumulation of debris and overstress of deflectable components.

Another prior art latch for an electrical connector is depicted in U.S. Pat. No. 4,749,372 which issued to Betsui on June 7, 1988. The connector depicted in U.S. Pat. No. 4,749,372 includes a deflectable latch disposed between a pair of parallel shroud side walls. This arrangement of a latch with shroud side walls may prevent the latch from snagging wires of nearby harness assemblies. However, this design does not provide adequate protection against accumulation of debris or against overdeflection of the latch. Furthermore this design does not prevent a wire from being snagged between the latch and a shroud wall thereof. Similar arrangements of a deflectable latch with parallel shroud walls are depicted in U.S. Pat. No. 4,710,135 which issued to Aoyama et al. on Dec. 1, 1987, and in U.S. Pat. No. 4,801,275 which issued to Ikeda et al. on Jan. 31, 1989. In each of these prior art connectors, overstress of the latch, snagging of wires, and accumulation of debris is not adequately protected against.

A slightly different version of a latching structure is depicted in U.S. Pat. No. 3,179,738 which issued to DeLyon on Apr. 20, 1965. The connector of U.S. Pat. No. 3,179,738 shows a latch structure that is disposed intermediate connector walls defining terminal receiving cavities. The outboard disposition of terminals is considered undesirable in many applications, and would therefore limit the application of this connector design. Furthermore, the means for preventing overstress is awkward and is not entirely effective.

In view of the above, it is an object of the subject invention to provide an electrical connector which enables efficient positive locking to another connector.

It is another object of the subject invention to provide an electrical connector with latch means that cannot be overstressed or overdeflected.

Still a further object of the subject invention is to provide an electrical connector having shrouds for positively preventing hooking of nearby wires by either the locking portion or the actuating portion of the latch.

Yet a further object of the subject invention is to provide an electrical connector that can be manufactured efficiently without complex or costly molds.

SUMMARY OF THE INVENTION

The subject invention is directed to an electrical connector comprising a housing having a body for receiving a plurality of electrically conductive terminals therein. The housing may be molded from a nonconductive material and may be of unitary construction.

The electrical connector of the subject invention is mateable with another electrical connector such that the terminals in the respective connectors achieve high quality electrical connection therebetween. To ensure that such high quality electrical connection is maintained through all ranges of anticipated operating conditions, the electrical connector of the subject invention is provided with a latch for locking engagement with corresponding locking structure on the mateable electrical connector. The latch of the subject connector comprises locking means for locking engagement with the locking structure on the mateable connector and actuator means for selectively deflecting the locking means to achieve unmating. In the typical embodiment, the latch will be constructed to automatically engage the locking structure on the mated connector as part of the mating process. To achieve unmating, however, the actuator means of the latch may be deflected or otherwise actuated to disengage the locking means from the locking structure of the mated connector.

In a preferred embodiment, as explained further herein, the latch may define an elongated structure which is deflectable about a centrally disposed root. The locking means may be disposed on one side of the root, while the actuator means may be disposed on the other side of the root. Thus, deflection of the actuator toward the body of the connector housing will urge the locking means away from the body of the connector housing.

As noted above, deflectable portions of an electrical connector often can be damaged by overdeflection. Furthermore, latches or Other cantilevered members of an electric connector may snag or fishhook nearby wires. Such snagging can further damage the connector or the wires and can affect the intended operation of an electrical connector by limiting movement of a deflectable component or by preventing complete seating of two mateable connector components. Furthermore, as noted above, electrical connectors often are employed in environments that accumulate dirt and debris. Such debris can further affect or limit the deflectability of an electrical connector component, such as the above described latch.

To protect against such overdeflection, snagging of wires and accumulation of dirt, the latch of the subject electrical connector is provided with a shroud. The shroud is formed in two separate parts. A first part may be unitarily molded with the electrical connector housing and may be disposed to prevent a first portion of the latch from overdeflection, snagging of wires and/or accumulation of debris. The second portion of the shroud is selectively engageable with the first portion to further contribute to protection, including protection that is not readily afforded by the first portion of the shroud. The second portion of the shroud may be part of a seal structure that is mountable to the electrical connector housing. The two portions of the shroud are constructed to enable the locking means of the latch to access the locking structure on the mateable electrical connector and to enable access of the actuator means.

In a preferred embodiment, as explained further below, the latch may be unitarily molded with the electrical connector housing and the first portion of the shroud may further be unitarily molded therewith to protect the locking means of the latch. The second portion of the shroud may be unitarily molded with a wire seal cover that is selectively engageable with the electrical connector housing. This second portion of the shroud may be configured to protect the actuator means of the latch but to permit sufficient access to the actuator means for enabling disengagement of the electrical connector from a mated connector. The first and second portions of the shroud may be disposed in abutting relationship or other such engagement upon mounting of the wire seal cover to the electrical connector housing. In this manner, the latch of the electrical connector is substantially completely enclosed. Snagging of wires by either the locking means or the actuator means of the latch is positively prevented by the two part shroud. However, a first part of the shroud is constructed to enable a locking means of the latch to engage the locking means of a mateable connector, while the second portion of the shroud is constructed to permit actuation of the latch for achieving unmating.

BRIEF DESCRIPTION OF THE DRAWINGS

FIG. is an exploded perspective view of an electrical connector in accordance with the subject invention.

DETAILED DESCRIPTION OF THE PREFERRED EMBODIMENT

Figure 1:
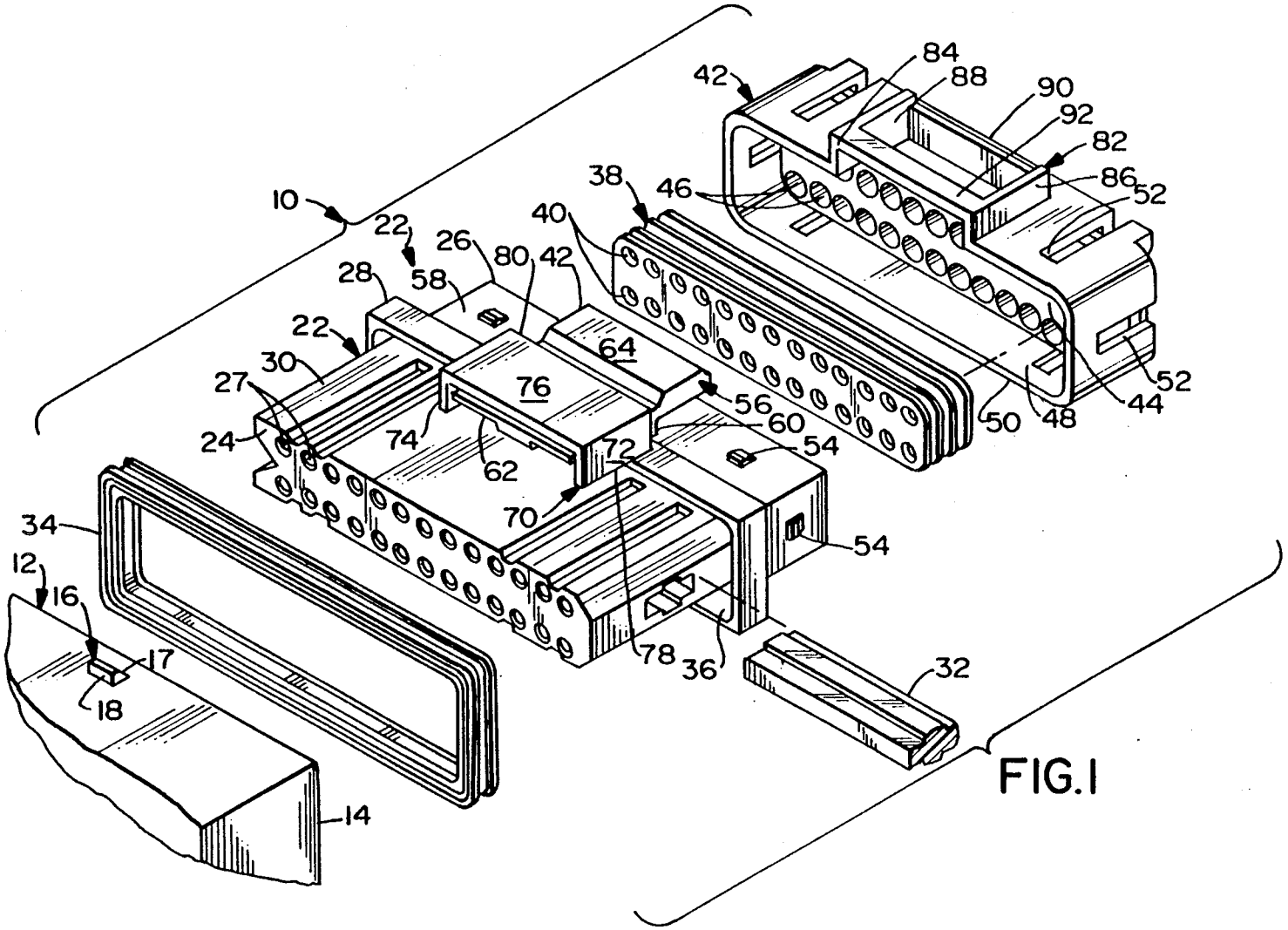

The electrical connector of the subject invention is identified generally by the numeral 10 in FIG. 1. The connector 10 is intended to be lockingly but releaseably mateable with a header assembly 12. More particularly, the header assembly 12 includes a mating face 14 having a mating cavity for receiving a portion of the electrical connector 10. The header assembly 12 further includes an externally disposed locking detent 16 having a ramped forward face 17 and opposed locking face 18.

The electrical connector 10 of the subject invention includes a unitarily molded electrical connector housing 20 having a body 22 defining a forward mating end 24 and an opposed rearward wire receiving end 26 with a plurality of terminal receiving cavities 27 extending therebetween. The terminal receiving cavities 27 are dimensioned to receive wire mounted terminals (not shown) that are mateable with terminals in the header assembly 12. The housing 20 includes a flange 28 projecting outwardly from the body 22 intermediate the forward mating end 24 and the rearward wire receiving end 26. A mating portion 30 of the housing body 22 disposed forwardly of the flange 28 will be received within a mating cavity (not shown) extending into the mating face 14 of the header assembly 12. In the fully mated condition, the flange 28 of the housing 20 will be in abutting or slightly overlapping relationship with the forward mating end 14 of the header assembly 12. It follows that in this fully mated condition, portions of the housing body 22 between the rearward wire receiving end 26 thereof and the flange 28 of the housing 20 will be external to the header assembly 12. FIG. 1 further shows a terminal position assurance component 32 that is receivable in the housing 20. The terminal position assurance component 32 is operative to ensure proper seating of terminals (not shown) in the housing 20 and to prevent unintended displacement of terminals therein. The terminal position assurance component 32 is not relevant to the locking means of the subject invention. However, the extremely effective terminal position assurance component 32 generally depicted in FIG. 1 is described in greater detail in copending application Ser. No. 608,782 now U.S. Pat. No. 5,044,991.

The connector 10 further includes a front seal 34. The front seal 34 is of frame-like configuration and is dimensioned to be slidably mounted over the mating portion 30 of the housing body 22. The front seal 34 is advanced rearwardly over the mating portion 30 and is seated in a cavity 36 defined on the forward face of the flange 28. The front seal 34 is formed from an elastomeric material and will sealingly engage the front mating face 14 of the header assembly 12 for contributing to environmental sealing of the electrical connector 10.

The connector 10 further comprises a rear mounted elastomeric wire seal 38. The rear mounted wire seal 38 is provided with a plurality of apertures extending therethrough for receiving the wires (not shown) that will extend from the connector 10. The wire seal 38 is mounted adjacent the rear wire receiving end 26 of the housing body 22 for further contributing to environmental sealing.

The connector 10 further comprises a wire seal cover 42. The wire seal cover is unitarily molded to define a rear wall 44 having a plurality of apertures 46 extending therethrough for receiving the wires (not shown) of the connector 10. A peripheral side wall 48 extends unitarily forwardly from the rear wall 44 and defines an open-ended front 50 for the wire seal cover 42. The peripheral side wall 48 of the wire seal cover 42 is dimensioned to be slidably disposed over both the wire seal 38 and portions of the housing body 22 disposed between the rearward wire receiving end 24 thereof and the flange 28 of the housing 20. The peripheral side wall 48 of the wire seal cover 42 is characterized by locking apertures 52 which are dimensioned and disposed to lockingly engage detents 54 defined on external portions of the housing body 22 intermediate the rearward wire receiving end 24 and the flange 28 of the housing 20, the connector body 22 and the seal cover containing a single set of electrical terminal which can mate with the header assembly 12. The wire seal cover 42 functions to protect the wire seal 38 and to ensure that the wire seal 38 remains in tight sealing engagement with both the housing 20 and the wires (not shown) extending into the body 22 of the housing 20.

Figure 2:
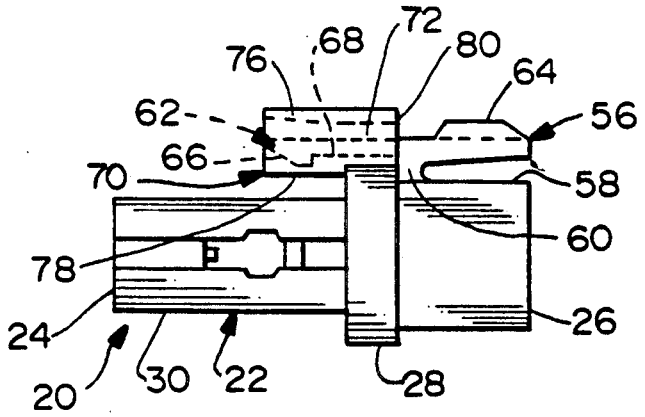
FIG. 2 is a side elevational view of the housing of the connector shown in FIG. 1.
Figure 3:
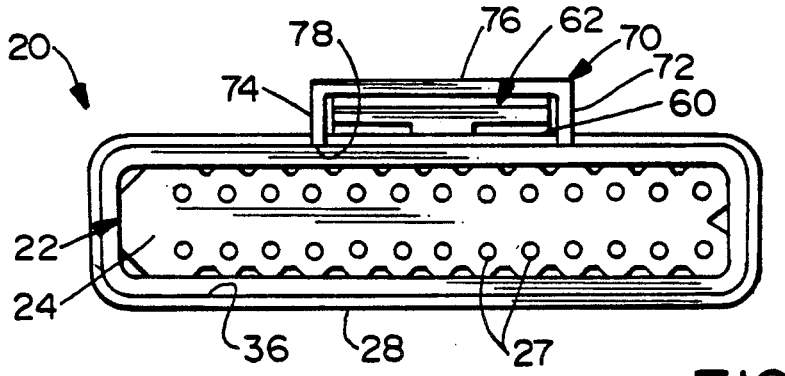
FIG. 3 is a front elevational view of the housing.
Figure 4:
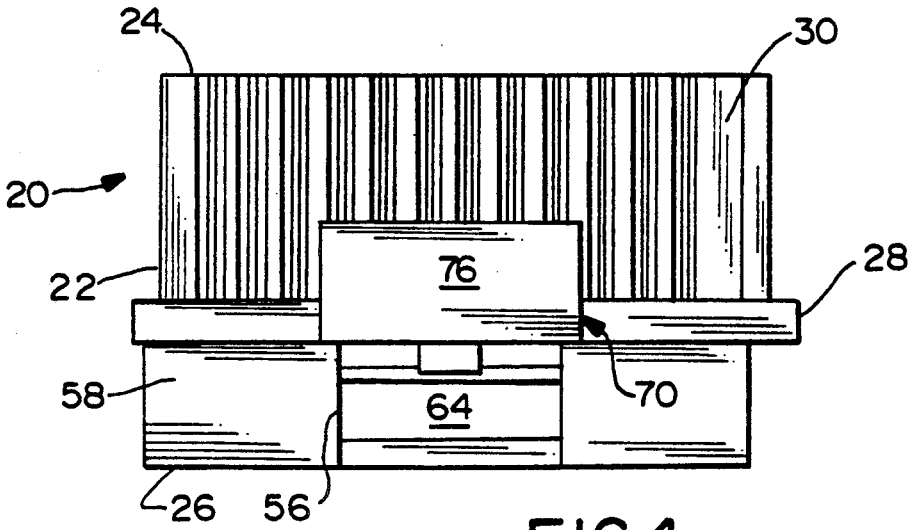
FIG. 4 is a top plan view of the housing.
Figure 5:
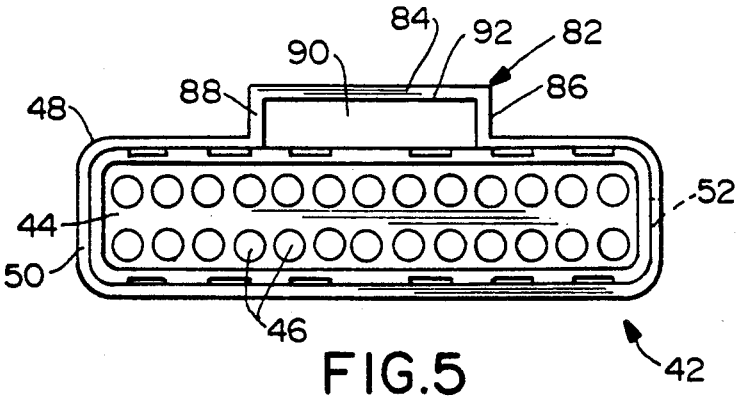
FIG. 5 is a front elevational view of the wire seal cover of the subject invention.
Figure 6:
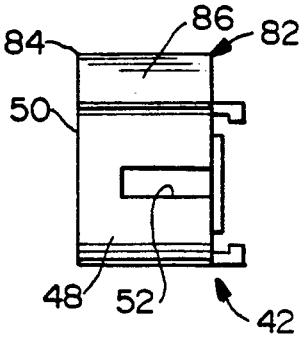
FIG. 6 is a side elevational view of the wire seal cover shown in FIG. 5.
Figure 7:
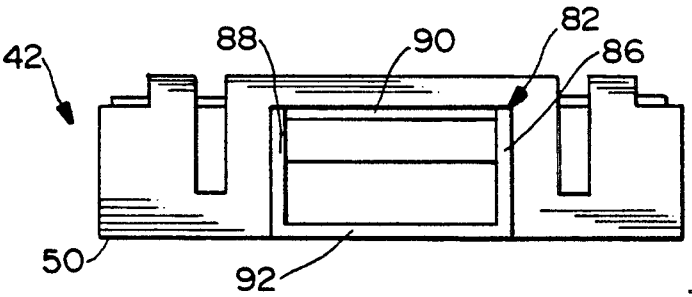
FIG. 7 is a top plan view of the wire seal cover.

As noted above, it is important to ensure that the terminals (not shown) in the housing 20 are maintained in high quality electrical connection with corresponding terminals of the header assembly 12. For this purpose, the connector 10 is provided with a latch which is identified generally by the numeral 56 in FIGS. 1-4, 8 and 9. As shown most clearly in FIG. 2, the latch 56 extends unitarily from a top wall 58 of the housing body 22. More particularly, the latch 56 includes a root 60 extending unitarily from the top wall 58 of the housing body 22 at a location thereon immediately rearwardly of the flange 28 of the housing 20. The latch 56 further comprises a locking beam 62 projecting forwardly from the root 60 and an actuator 64 projecting rearwardly from the root 60. The locking beam 62 and the actuator 64 lie rigidly substantially in a common plane and are deflectable in unison about the root 60. Thus, the locking beam 62 will deflect away from the housing body 22 in response to movement of the actuator 64 toward the top wall 58 of the body 22. Conversely, the actuator 64 will be deflected toward the top wall 58 in response to a deflection of the locking beam 62 about the root 60 and away from the housing body 22 due to forces generated during mating, as explained herein.

The forward end of the locking beam 62 includes a ramped leading face 66 which is aligned and disposed to engage the ramped leading face 17 of the locking detent 16 on the header assembly 12 during mating. This engagement of the opposed ramped faces 66 and 17 during mating will generate deflection of the locking beam 62 about the root 60 and away from opposed surfaces of the housing 20. The forward end of the locking beam 62 is further characterized by a locking surface 68 for lockingly engaging the surface 18 on the locking detent 16 of the header assembly 12. In particular, after sufficient movement of the connector 10 into mating engagement with the header assembly 12, the locking surface 68 on the locking beam 62 will align with the locking surface 18 on the locking detent 16. This will enable the locking beam 62 and the actuator 64 to resiliently rotate in unison about the root 60 to achieve locked engagement of the surfaces 68 and 18. Unmating can be achieved by urging the actuator 56 toward the surface 58 of the body 22. These forces exerted on the actuator 56 will simultaneously cause the locking beam 62 to rotate about the root 60 and away from the locking detent 16 on the header assembly 12.

As noted above, the locking members of an electrical connector are subject to snagging or fishhooking with adjacent wires. Such snagging can make it difficult to either completely mate the connector with a header assembly or can complicate the unmating by preventing complete depression of the actuator. In response to such difficulties, a technician may exert unintended forces on the connector that can be destructive to either the connector or to a nearby electrical component. For example, the snagging can lead to overdeflection or overstress of a portion of the latch which would prevent secure mating or unmating. In many situations, the connector may be used in a portion of the engine compartment that is subject to accumulation of dirt and debris. Such accumulation of dirt and debris conceivably could prevent complete depression of the actuator and thereby impede attempts to unmate the connector.

The connector 10 of the subject invention is provided with an efficient shroud assembly that positively prevents the above described problems that had existed in many prior art connectors. More particularly, a housing shroud 70 is unitarily molded with the housing 20 to enclose and protect the locking beam 62 of the latch 56. The housing shroud 70 includes first and second side shroud walls 72 and 74 respectively which extend upwardly and forwardly from the flange 28 of the housing 20 on opposite respective sides of the locking beam 62. A top shroud wall 76 extends between the side shroud walls 72 and 74 of the housing shroud 70 and completely cover the locking beam 62 of the latch 56. Thus, the locking beam 62 of the latch 56 is protected on three sides to positively avoid the potential snagging of wires and the accumulation of debris. The housing shroud 70 is opened on its forward end for permitting the locking beam 62 of the latch 56 to slide into locked engagement with the locking detent 16 on the header assembly 12. A small slit in 78 is further defined between forward portions of the housing shroud 70 and the mating portion 30 of the housing body 22 for receiving a portion of the wall of the header assembly 12 in proximity to the mating face 14 thereof. The rearward end 80 of the housing shroud 70 is substantially aligned with the root 60 of the latch 56 and does not perform a protecting function relative to the actuator 64.

Figure 8:
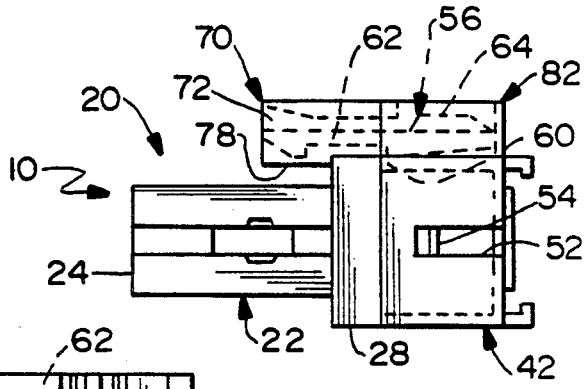
FIG. 8 is a side elevational view of the assembled electrical connector.
Figure 9:
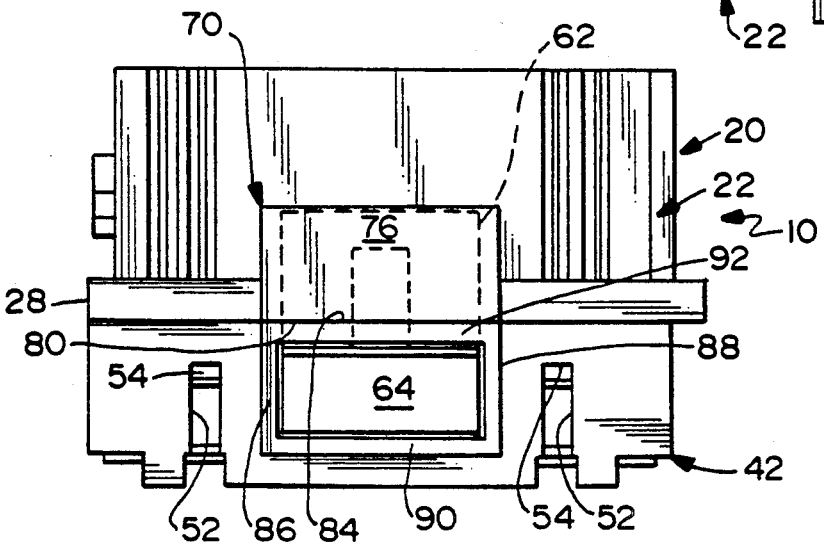
FIG. 9 is a top plan view of the assembled electrical connector.

Further protection of the latch 56 is provided by a cover shroud 82 which is unitarily molded with the wire seal cover 42. The cover shroud 82 includes an opened forward end 84 which is dimensioned and disposed to abut against the rearward end 80 of the housing shroud 70. The cover shroud 82 further comprises opposed side shroud walls 86 and 88 which are disposed in spaced parallel relationship, and extend rearwardly from the respective side shroud walls 72 and 74 of the housing shroud 70 and on opposite respective sides of the actuator 64. A rear shroud wall 90 extends orthogonally between the side shroud walls 86 and 88 and is in slightly spaced relationship to the extreme rear end of the actuator 64 when the wire seal cover 42 is mounted on the housing. A top shroud wall 92 extends between the side shroud walls 86 and 88 generally adjacent the forward opened end 84 of the cover shroud 82. The top wall 92 is disposed to abut and extend slightly rearwardly from the top shroud wall 76 of the housing shroud 70. However, the top shroud wall 92 does not extend the entire distance rearwardly to the rear shroud wall 90 of the cover shroud 82. Rather, a top opening is defined to enable the actuator 64 to be accessed for deflecting the latch 56 during unmating of the connector 10. However, the cover shroud 82 achieves substantial protection of the latch 56. In particular, the side walls 86 and 88 and the rear shroud wall 90 positively prevent snagging of wires by the actuator 64 and substantially prevent accumulation of debris between the actuator 64 and the top wall 58 of the housing body 22. In the assembled condition of the connector 10 as depicted in FIGS. 8 and 9, the housing shroud 70 provides substantially complete protection for the forward end of the latch 56, while the cover shroud 82 provides substantially complete protection for the rearward end of the latch 56. Snagging or fishhooking of wires at either end is positively prevented. The potential for accumulation of debris also is eliminated or very substantially reduced. Despite this complete protection, the opened forward end of the housing shroud 70 ensures positive efficient locking of the connector 10 with the header assembly 12. Furthermore, the opening at the top rearward portion of the cover shroud 82 enables efficient actuation of the latch 56 to achieve unmating.

While the invention has been described with respect to a preferred embodiment, it is apparent that various changes can be made without departing from the scope of the invention as defined by the appended claims.

We claim:

1. An electrical connector having a unitarily molded first housing structure and a unitarily molded second housing structure in locked engagement with the first housing structure, said first and second housing structures together adapted to contain a single set of electrical terminals which can mate with a complementary electrical connector the first housing structure comprising latch means for locked but releasable mating of said electrical connector with a second connector, said latch means comprising deflectable locking means for lockingly engaging the second connector and actuating means for selectively deflecting the locking means, said first housing structure further comprising a first shroud at least partly enclosing a first portion of said latch means, said second housing structure comprising a second shroud at least partly enclosing a second portion of said latch means of said first housing structure, whereby the first and second shrouds combine to substantially prevent the latch means from snagging wires and accumulating debris.

2. An electrical connector as in claim 1 wherein said first shroud partly encloses the locking means, and wherein the second shroud partly encloses the actuating means.

3. An electrical connector as in claim 1 wherein the first housing structure comprises a body for receiving electrical terminals therein, said latch means comprising a root extending from the body, the locking means of the latch means defining a locking beam extending deflectably from the root in a first direction, the actuating means of the latch means defining an actuator extending in a second direction from the root and being substantially rigid with the locking beam.

4. An electrical connector as in claim 3 wherein said first shroud comprises at least one shroud wall extending generally parallel to the locking beam, and wherein the second shroud comprises at least one wall extending generally parallel to the actuator.

5. An electrical connector as in claim 4 wherein the wall of the first shroud is disposed in engagement with the wall of the second shroud.

6. An electrical connector as in claim 4 wherein the first shroud comprises a pair of side walls disposed on opposite respective sides of the locking beam and a top wall extending unitarily between the side walls such that the locking beam is disposed intermediate the top wall of the shroud and the body of the housing.

7. An electrical connector as in claim 6 wherein the second shroud comprises a pair of side walls disposed on opposite respective sides of the actuator, the side walls of the second shroud engaging the side walls of the first shroud.

8. An electrical connector as in claim 7 wherein the second shroud further comprises an end wall extending from the second housing structure between the side walls of the second shroud and in spaced relationship to the actuator.

9. An electrical connector as in claim 8 wherein the second shroud further comprises a top wall extending between the side walls of the second shroud and generally adjacent the top wall of the first shroud, the top wall of the second shroud being in spaced relationship to the end wall thereof for permitting access to the actuator of the latch means.

10. An electrical connector comprising a housing having a body defining a forward mating end, a rearward wire receiving end and a plurality of terminal receiving cavities extending therebetween, said housing comprising a deflectable latch for locking the mating end of the housing body with a second connector, a wire seal cover lockingly engaged with the rear wire receiving end of the housing body, wherein the improvement comprises:

the latch being unitarily molded with the connector housing and comprising a route extending from the body of the housing, a locking beam in spaced relationship to the housing body and extending deflectably forwardly toward the mating end thereof, an actuator in spaced relationship to the housing body and extending substantially rigidly from the locking beam rearwardly toward the rearward wire receiving end of the body;

a pair of housing side shroud walls unitary with the housing and disposed on opposite respective sides of the locking beam for preventing accumulation of debris between the locking beam and the housing body; and a pair of cover shroud side walls unitary with the wire seal cover and disposed on opposite respective sides of the actuator for preventing accumulation of debris intermediate the actuator and the body of the housing.

11. An electrical connector as in claim 10 further comprising a housing top shroud wall extending unitarily between the housing side shroud walls such that the locking beam is intermediate the housing top shroud wall and the body of the housing.

12. An electrical connector as in claim 11 further comprising a cover rear shroud wall extending unitarily from the wire seal cover and between the cover side shroud walls, said cover rear shroud wall being disposed in spaced relationship to the actuator and intermediate the actuator and the rear wire receiving end of the connector.

13. An electrical connector as in claim 12 further comprising a cover top shroud wall extending unitarily between the cover side shroud walls and in spaced relationship to the cover rear shroud wall such that the actuator is accessible intermediate the side, rear and top shroud walls of the cover, the top shroud wall of the cover being in abutting engagement with the top shroud wall of the housing.

* * * * *